US008968834B2

(12) United States Patent
Konyashin et al.

(10) Patent No.: US 8,968,834 B2
(45) Date of Patent: Mar. 3, 2015

(54) WEAR PART WITH HARD FACING

(76) Inventors: Igor Yuri Konyashin, Burghaun (DE); Bernd Heinrich Ries, Burghaun (DE); Frank Friedrich Lachmann, Burghaun (DE)

( * ) Notice: Subject to any disclaimer, the term of this patent is extended or adjusted under 35 U.S.C. 154(b) by 0 days.

(21) Appl. No.: 13/417,840

(22) Filed: Mar. 12, 2012

(65) Prior Publication Data

US 2012/0177828 A1 Jul. 12, 2012

Related U.S. Application Data

(62) Division of application No. 12/994,905, filed as application No. PCT/IB2009/054029 on Sep. 15, 2009.

(30) Foreign Application Priority Data

Sep. 15, 2008 (GB) ..... 0816836.1

(51) Int. Cl.
*B05D 3/02* (2006.01)
*C23C 30/00* (2006.01)
(Continued)

(52) U.S. Cl.
CPC ..... *C23C 30/005* (2013.01); *C22C 32/0052* (2013.01); *C23C 26/02* (2013.01); *C23C 28/044* (2013.01)
USPC ..... 427/376.4

(58) Field of Classification Search
USPC ..... 427/576.4, 576.43
See application file for complete search history.

(56) References Cited

U.S. PATENT DOCUMENTS 3,475,161 A * 10/1969 Ramirez ..... 427/190
3,725,016 A 4/1973 Mal et al.
(Continued)

FOREIGN PATENT DOCUMENTS

DE 3618198 A1 12/1987
DE 4419996 A1 4/1995
(Continued)

OTHER PUBLICATIONS

Mari, D et al.: "Measurement of residual thermal scree in WC-Co by neutron diffraction", *Int. Journal of Refractory Metals & Hard Materials*, 27 (2009), pp. 282-287.
(Continued)

*Primary Examiner* — Nathan Empie
(74) *Attorney, Agent, or Firm* — Frommer Lawrence & Haug LLP; Ronald R. Santucci

(57) ABSTRACT

The invention relates to a wear part or tool comprising a body containing an iron-group metal or alloy, a wear-resistant layer metallurgically bonded to a surface of the body through an intermediate layer, characterized in that the wear-resistant layer comprises at least 13 vol. % of grains of metal carbide selected from the group consisting of WC, TiC, VC, ZrC, NbC, $Mo_2C$, HfC and TaC and grains of $(Cr,Me)_xC_y$ and a metal based phase comprising of a solid solution of 0.5 to 20% Cr, 0.2 to 15% Si, and 0.2 to 20% carbon, where Me is Fe, Co and/or Ni; and the intermediate layer has a thickness of 0.05 to 1 mm and comprises Si in amount of 0.1 to 0.7 of that in the wear-resistant layer, chromium in amount of 0.1 to 0.6 of that in the wear-resistant layer and the metal of the metal carbide in amount of 0.2 to 0.6 of that in the wear-resistant layer and to a method of producing such a wear part.

8 Claims, 11 Drawing Sheets

(a)

(b)

(51) Int. Cl.

| | |
|---|---|
| ***C22C 32/00*** | (2006.01) |
| ***C23C 26/02*** | (2006.01) |
| ***C23C 28/04*** | (2006.01) |

(56) References Cited

U.S. PATENT DOCUMENTS

| | | | | |
|---|---|---|---|---|
| 3,836,341 | A | 9/1974 | Saltzman et al. | |
| 4,136,230 | A | 1/1979 | Patel | |
| 4,731,253 | A | 3/1988 | DuBois | |
| 4,743,515 | A | 5/1988 | Fischer et al. | |
| 4,820,482 | A | 4/1989 | Fischer et al. | |
| 5,066,553 | A | 11/1991 | Yoshimura et al. | |
| 5,375,759 | A | 12/1994 | Hiraishi et al. | |
| 5,623,723 | A | 4/1997 | Greenfield | |
| 5,648,119 | A | 7/1997 | Grab et al. | |
| 5,660,939 | A | 8/1997 | Burdett | |
| 5,755,299 | A | 5/1998 | Langford, Jr. et al. | |
| 5,856,626 | A | 1/1999 | Fischer et al. | |
| 5,957,365 | A | 9/1999 | Anthon | |
| 6,066,553 | A | 5/2000 | Sandhu et al. | |
| 6,138,779 | A | 10/2000 | Boyce | |
| 6,436,470 | B1 * | 8/2002 | Iacocca et al. | 427/201 |
| 6,469,278 | B1 | 10/2002 | Boyce | |
| 6,649,682 | B1 | 11/2003 | Breton et al. | |
| 6,709,065 | B2 | 3/2004 | Peay et al. | |
| 7,172,256 | B2 | 2/2007 | Sleep et al. | |
| 7,204,560 | B2 | 4/2007 | Mercier et al. | |
| 2005/0035649 | A1 | 2/2005 | Mercier et al. | |
| 2005/0147850 | A1 | 7/2005 | Tillman et al. | |
| 2005/0155694 | A1 * | 7/2005 | Sim et al. | 156/81 |
| 2007/0092727 | A1 | 4/2007 | Kosters et al. | |
| 2008/0240879 | A1 | 10/2008 | Dourfaye et al. | |

FOREIGN PATENT DOCUMENTS

| | | | |
|---|---|---|---|
| EP | 1 029 629 | A2 | 8/2000 |
| EP | 1 029 629 | A3 | 8/2000 |
| EP | 1029629 | | 8/2000 |
| EP | 1548136 | | 6/2005 |
| GB | 1031432 | | 6/1966 |
| GB | 1506915 | | 5/1978 |
| GB | 2167088 | | 5/1986 |
| GB | 2409467 | | 6/2005 |
| JP | 4883049 | A | 11/1973 |
| JP | 58-67803 | | 4/1983 |
| JP | 58-73762 | | 5/1983 |
| JP | 63220912 | | 9/1988 |
| JP | 02209448 | A | 8/1990 |
| JP | 04-337046 | A | 5/1991 |
| JP | 04337046 | | 11/1992 |
| JP | 05009510 | | 1/1993 |
| JP | 08073964 | A | 3/1996 |
| JP | H1046319 | A | 2/1998 |
| JP | 2003-225755 | A | 2/2002 |
| JP | 2003193172 | A | 7/2003 |
| JP | 2003225755 | | 8/2003 |
| JP | 2004059946 | A * | 2/2004 |
| JP | 2004131769 | A | 4/2004 |
| JP | 2005187944 | A | 7/2005 |
| KR | 2004-0070448 | A | 4/2004 |
| KR | 200470448 | | 8/2004 |
| SU | 1006196 | A1 | 3/1983 |
| WO | WO 2005/017317 | A1 | 2/2005 |
| WO | WO 2005/106183 | A1 | 11/2005 |
| WO | WO 2008/076689 | A1 | 6/2008 |
| WO | WO 2010/029518 | A1 | 3/2010 |
| WO | WO 2010/029522 | A2 | 3/2010 |

OTHER PUBLICATIONS

Roebuck, B.: "Magnetic Moment (Saturation) Measurement on Hardmetals", *Int. Journal of Refractory Metals & Hard Materials*, 14, (1996), pp. 419-424.

Combined Search and Examination Report issued by the UK Intellectual Property Office dated Oct. 24, 2008 for corresponding British application GB0816836.1.

English translation of office action issued by Japanese Patent Office for corresponding Japanese Application No. 2011-526622.

* cited by examiner (a)

(b)

(a)

(b)

WEAR PART WITH HARD FACING

This application is a division of U.S. patent application Ser. No. 12/994,905 filed Feb. 15, 2011 entitled "Wear Part with Hard Facing" which is a 371 filing of International Application PCT/IB2009/054029 filed Sep. 15, 2009 which claims priority benefits to British Application 0816836.1 filed Sep. 15, 2008, all disclosures of which are herein incorporated by reference.

INTRODUCTION

This invention relates to the field of steel wear parts or tools, with metallurgically bonded hard facings. Such parts may be used in a wide variety of applications such as earth boring, excavating, oil and gas drilling and construction, cutting of stone, rock, metals, wood and composite materials, and chip-forming machining.

BACKGROUND TO THE INVENTION

Cemented carbide, also called hard-metal, is class of hard material comprising a hard phase of metal carbides and/or carbo-nitrides, the metal being selected from groups IVa to VIa of the periodic table and a metallic alloy binder comprising one or more iron-group metals. Hard-metals are produced by a powder metallurgy method typically including the steps of milling, mixing, pressing and liquid-phase sintering. The sintering temperatures of the most commonly used WC—Co hard-metals are usually above the melting point of a eutectic temperature, which is in the range of about 1300 deg. C. to 1320 deg. C. The sintering temperatures used for another class of hard-metals called cermets and comprising TiC or TiCN with a Ni—Mo-based binder, are above the melting point in the Ti—C—Ni—Mo system of roughly 1280 deg. C.

Typically the sintering temperatures for hard-metals are above 1350 deg. C., which allows the formation of a large fraction of liquid phase during sintering in order to promote full density of the sintered product.

The term "wear part" is understood to mean a part or component that is subjected, or intended to be subjected to wearing stress in application. There are various kinds of wearing stress to which wear parts may typically be subjected such as abrasion, erosion, corrosion and other forms of chemical wear. Wear parts may comprise any of a wide variety of materials, depending on the nature and intensity of wear that the wear part is expected to endure and constraints of cost, size and mass. For example, cemented tungsten carbide is highly resistant to abrasion but due to its high density and cost is typically used only as the primary constituent of relatively small parts, such as drill bit inserts, chisels, cutting tips and the like. Larger wear parts may be used in excavation, drill bit bodies, hoppers and carriers of abrasive materials and are typically made of hard steels which are much more economical than cemented carbides in certain applications.

In order to prolong the working life of steel wear parts it is common for the wear parts to have hard facings, which are coatings of a harder material attached to the surface of a body, in this case, the wear part. Hard facings may be applied repeatedly to a wear part as previous hard facings wear away, thereby repeatedly restoring the wear part to a usable condition. There are various hard facing materials and methods known in the art. Welding, brazing and spraying of hard particles are examples of widely used methods.

In the welding method, a weld strip or rod comprising a welding alloy and grains of hard or super-hard materials is prepared and subjected to localised heating proximate a wear part surface, causing a portion of the wear part surface to melt and become metallurgically bonded to the hard facing. Hard facing methods which involve the formation of metallurgical bonding with the wear part (substrate) surface require heat to be applied to the wear part surface in order to raise its temperature to a level at which the bond can form. For example, in welding methods the heat may be applied by means of an electrical arc or current. The applied heat may result in the degradation or melting of a steel substrate. The minimum temperature that can be used depends on the composition of the hard facing. Where meta-stable, ultra-hard materials such as diamond grains are incorporated into a hard facing as is known in the art (see, for example, U.S. Pat. Nos. 5,755,299, 5,957,365, 6,138,779 and 6,469,278), the applied heat may substantially degrade important properties of those ultra-hard materials.

In the spraying method, a powder comprising a hard phase, typically tungsten carbide, is caused to impact the wear part surface with high energy, resulting in a dense layer of mechanically keyed hard particles becoming attached to the surface. Sprayed coatings typically do not from metallurgical bonds with the substrate surface unless the coatings have been treated at high temperature, which is typically necessary in order to increase the coating density and reduce or eliminate porosity. If the coatings comprise WC—Co, it may be necessary to treat the coating at high temperatures exceeding about 1,350 deg. C. Such high temperatures may result in the distortion or melting of the steel substrate body, which is highly undesirable. Another disadvantage of thermal spraying methods, such as flame, plasma or high velocity oxy-fuel (HVOF) spraying, is that they require expensive specialised equipment.

The direct sintering of hard-metal powders onto steel substrates has the potential of being relatively simple and economical. Unfortunately, this method is not practicable owing to the fact that the hard-metal shrinks during the sintering process, resulting in an inhomogeneous structure and severe cracking of the sintered layer (hard facing). Another major problem is the need to apply high temperature to the layer and steel substrate.

US Patent Publication No. 2007/0092727 teaches a wear part comprising diamond grains, a carbide phase such as tungsten carbide and a metallic alloy with liquidus temperature less than 1,400 deg. C. and preferably less than 1,200 deg. C. Two methods are taught for making the wear parts. In the first method an intermediate article comprising diamond grains is contacted with a source of both a selected infiltrant first alloy and a selected second alloy, the temperature of the source and intermediate article is raised to above the liquidus of the infiltrant alloy, causing the latter to infiltrate into the pores of the intermediate article. The time required for the temperature to be maintained above the liquidus is said to be about 15 minutes. Carbides are formed when components of the second alloy react with the diamond of the intermediate article. In the second method, which is more suitable for making larger wear parts, an intermediate material comprising diamond grains and an alloy selected from the first group and an alloy from the second group is subjected to hot pressing at a temperature lower than 1,200 deg. C. No infiltration is required in the second method.

This US patent publication also teaches a method for making diamond-containing wear parts using an alloy with a relatively low melting point, resulting in relatively less diamond degradation during manufacture. The economical viability of wear parts made according to these teachings is constrained by the cost of having a high content of diamond and other costly materials such as tungsten and other refractory metals throughout the body of the part, whereas such materials are typically necessary at the wear surfaces only.

Stainless steel alloys developed for the nuclear industry are taught in U.S. Pat. No. 5,660,939 and UK Patent No. 2,167,088, for example, and comprise chromium, nickel, silicon and carbon, but positively do not contain cobalt, which is generally unsuitable for use in a radio-active environment. These alloys are both wear and corrosion resistant.

U.S. Pat. No. 3,725,016 describes a method of coating a steel substrate with a hard metal coating. The coating is produced by spraying the components for the coating on to a surface of a steel substrate drying the coating and then raising the temperature of the coated steel substrate to a temperature above the liquidus temperature of the binder components of the coating. This elevated temperature is maintained for about half an hour. This long sintering time will result in considerable melting of both the binder components and the steel substrate.

There is a need to provide economically viable wear parts, more especially large wear parts comprising steel which parts exhibit enhanced wear behaviour. In particular, there is a need to coat or clad steel wear parts with a material that is more wear resistant than steel and which material is well bonded to the steel part, in order to prolong the working life of the part, rather than replace the steel part with one made substantially or entirely from a more expensive material. This is particularly so for steel wear parts which have non-planar or complex surfaces.

BRIEF SUMMARY OF THE INVENTION

According to a first aspect of the invention, there is provided a wear part or tool comprising:

a body containing an iron-group metal or alloy, a wear-resistant layer metallurgically bonded to a surface of the body through an intermediate layer, characterised in that:

the wear-resistant layer comprises at least 13 vol. % of grains of metal carbide selected from the group consisting of WC, TiC, VC, ZrC, NbC, $Mo_2C$, HfC and TaC grains, generally either rounded or facetted grains of average size within the range of 0.2 to 10 μm; grains of $(Cr,Me)_xC_y$ of average size within the range of 1 to 30 μm; and a metal based phase comprising a solid solution of 0.5 to 20% Cr, 0.2 to 15% Si, and 0.2 to 20% carbon, where Me is Fe, Co and/or Ni;

the intermediate layer has a thickness of 0.05 to 1 mm, typically 0.1 to 200 μm and comprises Si in amount of 0.1 to 0.7 of that in the wear-resistant layer, chromium in amount of 0.1 to 0.6 of that in the wear-resistant layer and the metal of the metal carbide in amount of 0.2 to 0.6 of that in the wear-resistant layer. The intermediate layer preferably has a microstructure of dendritic eutectic crystals dispersed in a matrix comprising at least 50% of the iron-group metal of the body.

Preferably the wear resistant material further comprises cobalt in an amount of greater than about 10% wt. and less than about 30% wt.

Preferably the iron-group metal of the body is iron.

Preferably the body is a steel body.

The wear resistant material may additionally comprise grains of ceramic materials other than metal carbides. It may therefore comprise grains of ceramic material selected from the group comprising oxides, nitrides, borides, carbo-nitrides, boro-nitrides and super-hard ceramic materials, such as diamond, cubic boron nitride, boron carbide and boron sub-oxide. The wear resistant material most preferably includes grains of diamond.

The combined amount of metal carbide grains and ceramic material grains in the wear resistant material is preferably greater than 40 vol. %, more preferably 60 vol. %, yet more preferably 70 vol. % and most preferably more than 80 vol. %.

Most preferably, the wear resistant material is more wear and/or corrosion resistant than the body of the wear part or tool, for example the steel body, to which it is bonded.

Most preferably, the metal based phase (binder component) of the wear resistant layer has a liquidus at or below 1300 deg. C., more preferably below 1280 deg. C. even more preferably below 1250 deg. C. and most preferably below 1160 deg. C.

The thickness of the intermediate layer will depend on the thickness of the wear resistant layer. Typically the wear resistant layer has thickness greater than 500 um, more preferably greater than 600 um, more preferably greater than 750 um, most preferably greater than 1000 um.

According to a second aspect of the invention there is provided a method of producing a wear part or tool according to any preceding claim including the steps of:

providing a body formed of an iron group metal or alloy, providing a composition of grains of a metal carbide and the components for a metal based phase comprising an iron-group metal, silicon and chromium, in particulate form, applying a layer of the composition to a surface of the body, raising the temperature of the layer and the surface of the body to above the liquidus of the components for the metal based phase and surface of the body, maintaining the raised temperature for a period of 30 seconds to 5 minutes, and allowing the components and surface of the body to return to a temperature below the liquidus temperature, i.e. to solidfy.

The raised temperature is preferably maintained for a period of 30 seconds to 3 minutes and more preferably for a period of 30 seconds to 2 minutes.

The need for the very fast sintering of a wear part or tool, particularly one which is steel, by holding the sintering at a relatively low temperature for the short time is related to the following obstacle. When the coating comprises much liquid phase during sintering and is applied to articles of complex shape or ones which contain non-planar surfaces, e.g. curved or rounded surfaces, the liquid phase tends to flow down the surface leaving the upper part of the surface uncoated. To prevent that and also to obtain an effective intermediate layer forming by melting the near-surface layer of the substrate together with the coating, the sintering process must carried out at a sintering temperature, preferably one in the range of 1150° C. to 1300° C., for time not exceeding 5 minutes, preferably for a time in the range of 30 seconds to 5 minutes.

Thus, the invention has particular application to the coating of wear parts which have complex and/or non-planar surfaces. The non-planar surfaces may be curved or rounded as found in road-planing tools, mining picks, control values used in the oil and gas industry and hoppers. Mining picks comprise a shank for locating in a pick body and a working end which is usually cone shaped. The cone shaped working end is coated with a layer of a wear resistant material of the invention. An example of a mining pick is illustrated by FIG. 11. The internal surface of a hopper is curved and it is this surface which has a layer of a wear resistant material of the invention applied to it. A control valve for the oil and gas industry comprises a cylindrical body having a plurality of holes formed therein, such as those illustrated by FIG. 3.

The composition of metal carbide and components for the metal based phase will typically be in the form of a paste, tape, strip, powder or liquid. The composition may additionally include an organic binder such as paraffin or other wax, methyl cellulose and the like. Preferably the composition is in the form of a paste or strip, which is sufficiently robust to handle and preferably has a degree of flexibility, i.e. is self-supporting.

Preferably the body of the wear part or tool is a steel body. Thus, the surface to which the wear resistant layer will be bonded, in this form of the invention, will be steel.

Where the wear resistant layer includes grains of a thermodynamically meta-stable phase such as diamond or cubic boron nitride (cBN), it is highly preferable that the grains are coated and that the method includes the step of coating the grains prior to their incorporation into the composition of carbide and components for the metal based phase Where such grains are diamond grains, it is preferable that the method includes the step of coating the grains with metal carbide, nitride, refractory metal or carbo-nitride and preferably with more than one layer, each layer comprising a different coating material. More preferably the diamond grains are coated with TiC, W, WC or combinations of these in one or more than one layer.

BRIEF DESCRIPTION OF THE DRAWINGS

Preferred embodiments of the invention will be described by way of non-limiting examples, and with reference to the accompanying drawings in which:

FIG. 6*a* shows the interface between the coated diamond grain and the binder as well the line at which Raman spectra were taken. FIG. 6*b* shows the Raman spectra taken through the line shown in FIG. 6*a*. On the left hand side the spectra comprise only peaks typical for diamond at nearly 1320 $cm^{-1}$ and no other peaks. When going further from left to right toward the diamond-coating-binder interface the diamond peaks become weaker. The Raman spectra do not comprise any signals being taken from the coating or binder surface, which is typical for carbides, metals and alloys. Note that there are no peaks except for the diamond peak at the diamond-coating-binder interface, especially peaks at nearly 1500 $cm^{-1}$ to 1600 $cm^{-1}$ typical for graphite, indicating that there is no graphite at the diamond-coating-binder interface.

SPECIFIC DESCRIPTION

Figure 1:
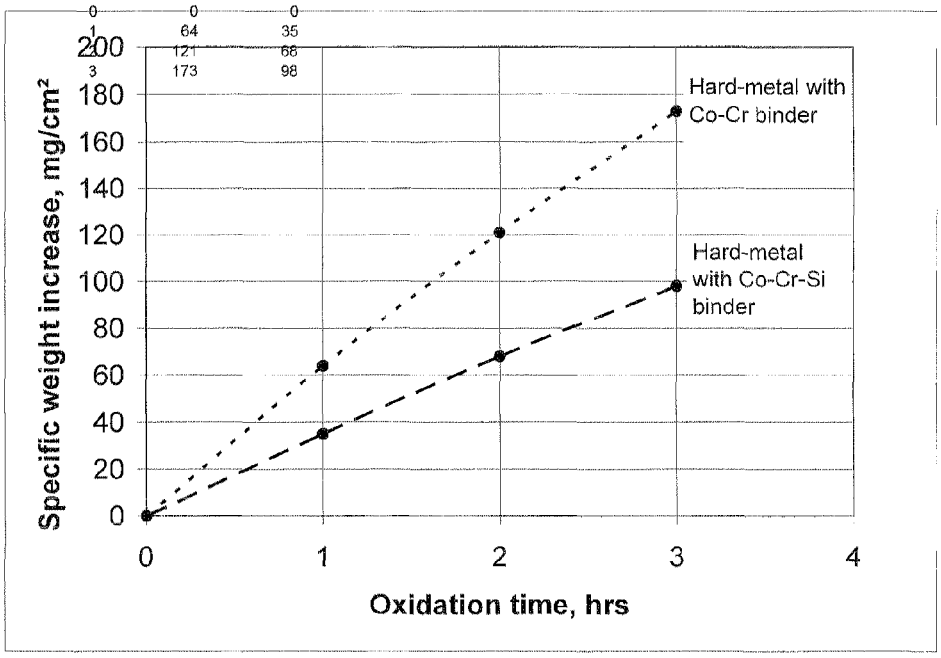
FIG. 1 is a graph showing the oxidation of samples of two hard-metals, namely i) hard-metal with the conventional Co—Cr and ii) hard metal with a Co—Cr—Si binder, as a function of time at an applied temperature of about 800 deg. C. The degree of oxidation is indicated by the degree of specific mass increase.

The term "metallurgical bond" is understood to mean strong attractive forces between atoms, molecules or articles, holding them together in a structure having crystalline or metallic characteristics. Metallurgical bonds are contrasted with mechanical bonds between articles, whereby the articles are held together mechanically.

The term "metallic alloy", or more simply "alloy", is understood to mean a material that comprises at least one metal and has a metallic, semi-metallic or inter-metallic character. It may additionally comprise a ceramic component.

A body (wear part) to which is metallurgically bonded a layer of wear resistant material comprising grains of hard and/or super-hard phases and a metal alloy binder comprising an iron group metal, such as iron, cobalt or nickel or alloys thereof, as well as silicon and chromium is provided. Grains of one or more types of refractory metal carbide are dispersed within the binder alloy, i.e. metal based phase of the wear resistant layer, and in a particularly preferred embodiment WC or TiC or a combination thereof, is present in the layer of wear resistant material (hard-facing layer) in an amount within the range of about 40 to about 80 wt. %. The carbide grains preferably have a mean equivalent diameter in the range 1 to 30 microns and more preferably in the range 3 to 20 microns. In another preferred embodiment, a super-hard phase such as diamond is additionally present in the hard-facing layer in an amount within the range of about 5 to 30 wt. %, and WC or TiC, or a combination thereof, is present in a combined amount within the range of about 24 to about 63 wt. %. The binder alloy may typically comprise a cobalt-iron alloy with dissolved silicon, tungsten, chromium and titanium.

It has been found that in the Me—Cr—Si—C system (where Me is Co, Ni or Fe) there is a low melting point eutectic of below 1280 deg. C., preferably below 1250 deg. C. and most preferably below 1160 deg. C. The eutectic composition has the desirable property that the melt readily wets certain carbides, especially TiC, VC, ZrC, NbC, MoC, HfC, TaC, WC and can effectively infiltrate a porous carbide pre-form during liquid-phase sintering at low temperatures within a relatively short time. Thus, the hard-metal based on the refractory carbides with the binder of the Me—Cr—Si—C system can be sintered to full density at very low temperatures. The hard-metals obtained in such a way have a combination of high mechanical and performance properties comparable with those of conventional WC—Co hard-metals. In a preferred embodiment, Co, Cr3C2 and Si are present in the weight % ratio 75:2:5, or about this ratio. Differential thermal analysis has indicated that this system melts at between 1140 and 1150 deg. C.

The wear-resistance of coated steel according to the invention exceeds that of ST50 carbon steel by an order of magnitude, is significantly higher than that of the hard-metal with 15% Co and is close to that of the hard-metals with 8% Co.

Figure 4:
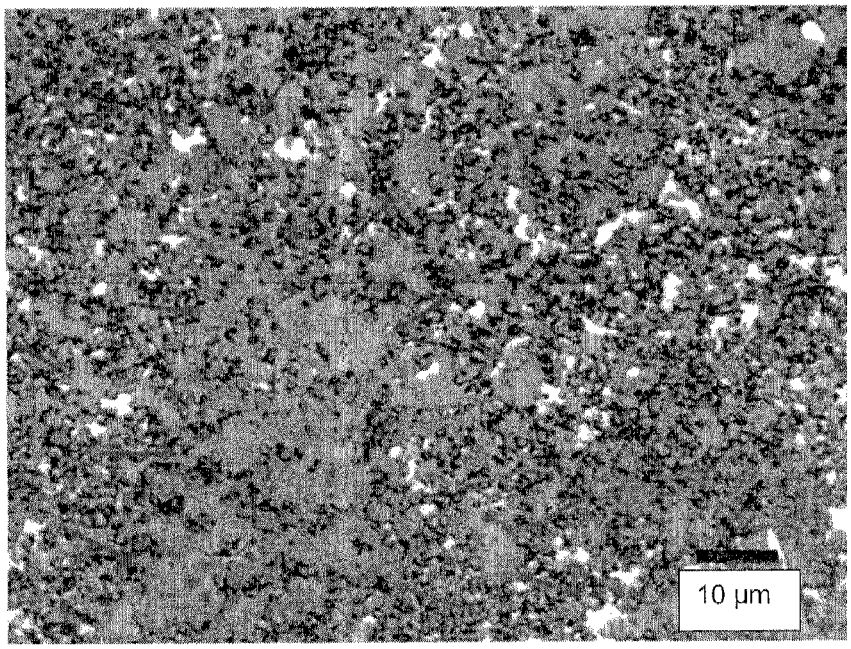
FIG. 4 shows the microstructure of a hard-metal of WC and Co—Cr—Si—C sintered at 1160 deg. C. for 5 minutes in vacuum, ×1000. The microstructure comprises facetted WC grains of nearly 0.5 to 5 μm, rounded grains of (Cr,Co)xCy of nearly 1 to 10 μm and interlayers of the Co-based binder among them.
Figure 5:
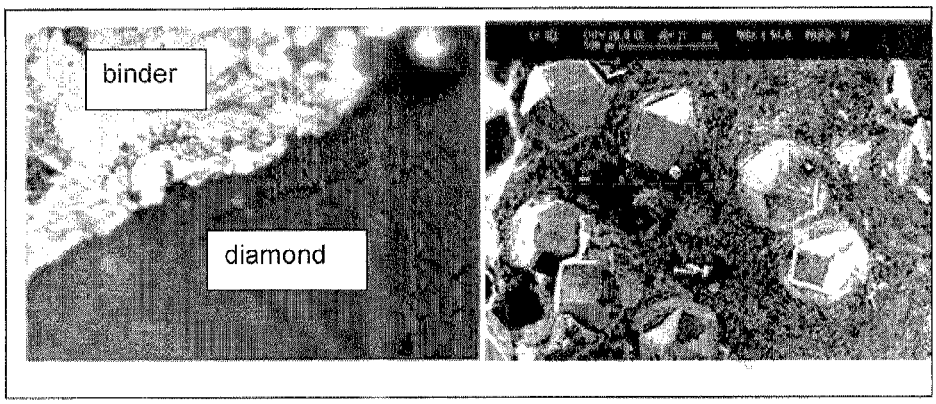
FIG. 5 shows TiC coated diamond (300-400 um) after sintering with Co—Cr—Si—C binder at 1160 deg. C. for 5 minutes.
Figure 6:
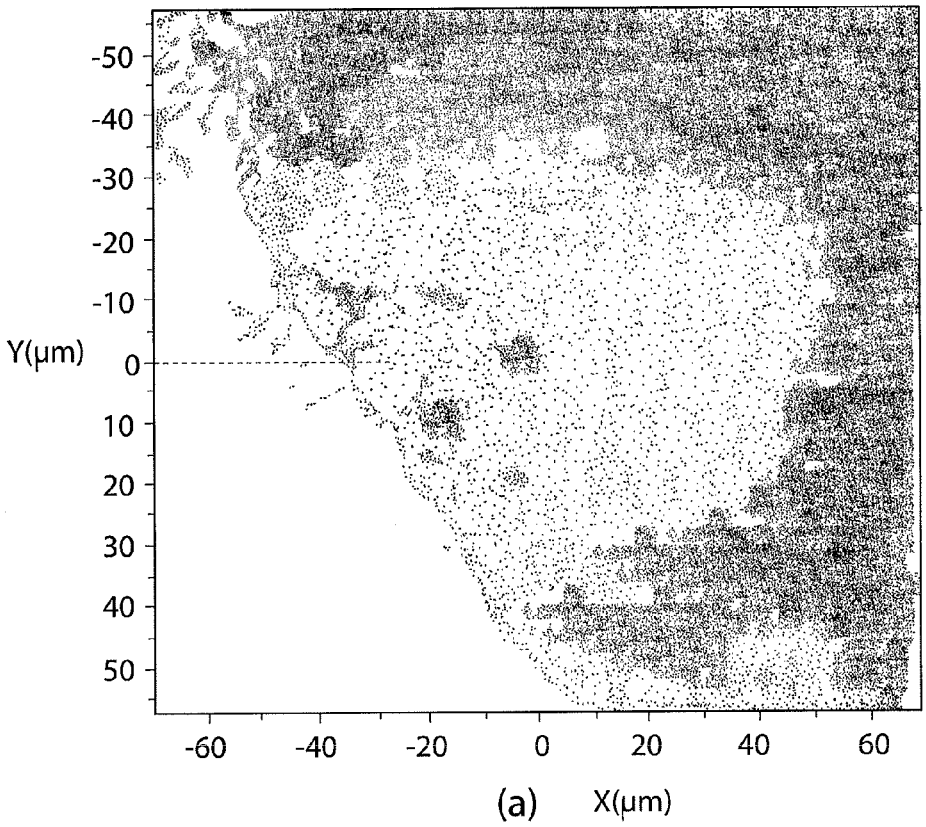
FIG. 6 shows results of Raman spectroscopy at the interface between TiC coated diamond and the Co—Cr—Si—C binder sintered at 1160 deg. C. for 5 min, indicating that there is no graphite at the interface.
Figure 6:
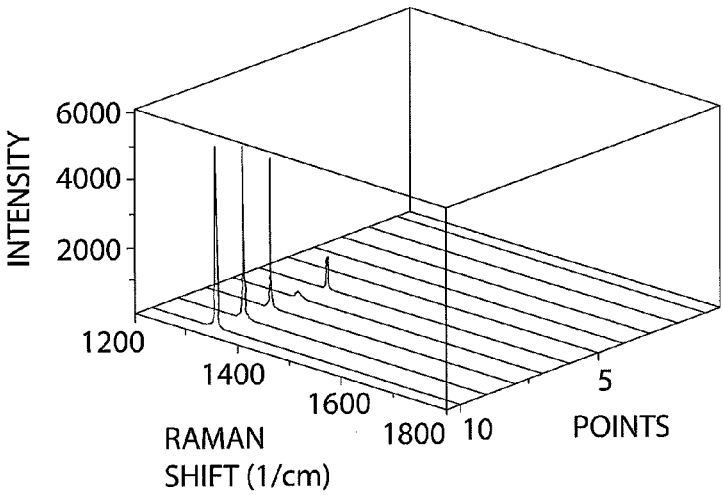
Figure 7:
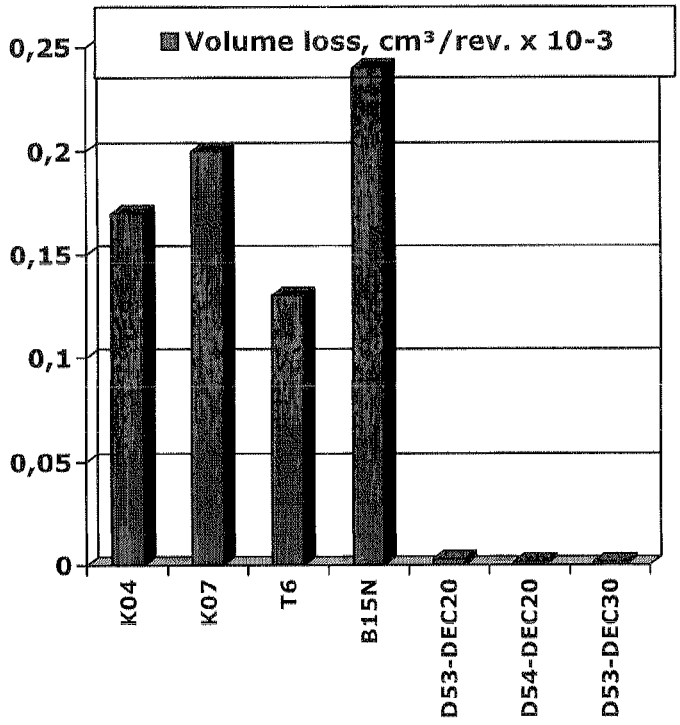
FIG. 7 shows the results of Sliding Test of diamond-containing hard-metals with the Co—Cr—Si—C binder against diamond grinding wheel. The sliding test is carried out in a similar way to the ASTM B611 wear test, except that a diamond grinding wheel is employed instead of a steel wheel and no alumina particles are used. The hard-metal wear was measured by weighing the samples before and after testing and the revolution number was 1000. The diamond grinding wheel having a designation of 1A1-200-20-10-16 was from the Wuxi Xinfeng Diamond Tolls Factory (China). The hard-metal grades tested were as follows: K04—WC-0.2% VC-4% Co, K07—WC-0.3% VC-0.2% Cr3C2-7% Co, T6—WC-6% Co, B15N—WC-6.5% Co. The diamond-containing hard-metals tested were as follows: D53-DEC20—the hard-metal matrix of 50 wt. % Co, 13 wt. % Cr3C2, 3 wt. % Si, 34 wt. % WC comprising 20 vol. % diamond; D54-DEC20—the hard-metal matrix of 35 wt. % Co, 9 wt. % Cr3C2, 2 wt. % Si, 54 wt. % WC comprising 20 vol. % diamond; D53-DEC30—the same hard-metal matrix as in D53-DEC20 but comprising 30 vol. % diamond. The figure indicates that the wear-resistance of the diamond-containing hardmetals is nearly two orders of magnitude higher than that of the conventional hardnnetals.
Figure 8:
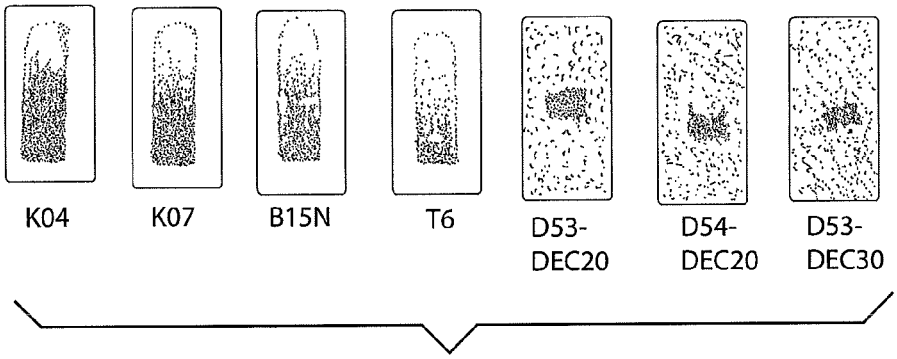
FIG. 8 shows the wear of the diamond-containing hardmetals described in detail in FIG. 7 with the Co—Cr—Si—C binder in comparison with WC—Co hard-metals after carrying out the sliding wear test, results of which are shown in FIG. 7. It can be seen that the wear of the diamond-containing hardmetals is nearly 2 orders of magnitude lower than that of the conventional hardmetals.

FIG. 4 illustrates the microstructure of an embodiment of a wear resistant layer of the invention. In particular, as can be seen from FIG. 4, the microstructure comprises facetted WC grains of nearly 0.5 to 5 μm, rounded grains of (Cr,Co)xCy of nearly 1 to 10 μm and interlayers of the Co-based binder among them.

In the method of the invention an intermediate pre-form of the composition comprising carbide particles and the components for the metal based phase may be produced by a method preferably including the steps of blending powder constituents together with an organic binder. The intermediate pre-form may be in the form of a paste, tape or strip, depending on the type of binder used and the extent to which moisture or other solvents have been removed. Typically the intermediate pre-form will be in the form of a layer once contacted with the steel substrate of the wear part.

The intermediate pre-form can be made using the following steps:

1. milling and/or blending the hard carbide phase with the metal or metal alloy powders;
2. admixing coated diamond grains or other super-hard grains to the mixture, where the inclusion of such super-hard grains is preferred (this step can be omitted if super-hard grains are not required in the hard-facing);
3. introducing an organic binder into the blend to form a slurry, the binder suspended in an aqueous or non-aqueous medium;
4. forming the slurry into a paste, tape or strip, typically involving the step of removing a certain fraction of the suspension medium.

In a preferred embodiment, Co, Cr3C2 and Si are present in the intermediate pre-form in the weight % ratio 75:20:5, or about this ratio. Differential thermal analysis has indicated that this system melts at between 1140 and 1150 deg. C. Where an intermediate pre-form comprising this blend is used, the temperature of the surface of the wear part (substrate) and intermediate pre-form is raised to within the range 1220 to 1240 deg. C. in order to allow the iron group metal or iron group metal alloy at the contact surface of the wear part to melt as well, so that liquid iron becomes available within the molten intermediate pre-form to alloy with the Cr, Si and Co. The temperature may be held at this level for about one minute.

The intermediate pre-form may applied to a surface of a substrate and both are heat treated preferably at low pressure, vacuum or some protective atmosphere at a temperature sufficient to cause an iron group metal or iron group metal alloy within the substrate to liquefy and infiltrate into the intermediate pre-form. The iron or iron alloy should be allowed to alloy with the metal alloy or alloys within the intermediate pre-form. The tendency of the alloy of the intermediate pre-form to shrink is compensated by the infiltration of the iron group metal or iron group metal alloy from the wear part, resulting in a dense, contiguous and substantially homogeneous layer (derived from the intermediate pre-form) devoid of substantial cracks after cooling. The hardness of the resultant layer may exceed 1000 HV10 and the layer has extremely high wear resistance. Steel wear part components with a hard-facing prepared as taught according to the present invention may subsequently be heat treated according to conventional steel heat treatment methods.

The incorporation of super-hard materials may improve certain properties of the coating (wear resistant material) such as hardness, corrosion resistance, abrasion resistance and/or thermal conductivity. As a consequence of the low temperature of formation of liquid phase within the hard-metal formulation (wear resistant material) of the invention, diamond grains may be incorporated within the material without the disadvantage of substantial diamond degradation or residual porosity. Where diamond grains are incorporated into the intermediate pre-form, they are preferably coated with protective coatings of carbide, carbo-nitrides and/or nitrides of metals of the IVa to IVa of the periodic table. A preferred coating is TiC with an average thickness of about 1 μm, deposited by chemical vapour deposition (CVD) from TiCl4-CH4-H2 gas mixtures in a rotating tube, as is well known in the art. In this case, the combination of the protective coatings on diamond grains with low sintering temperatures and short sintering time prevents or retards the degradation of the diamond grains by, for example, a process of thermally-promoted graphitisation whereby diamond converts to the soft graphitic form of carbon. A second function of the coating of the diamond grains may be that it promotes superior bonding and retention of the grains within the hard facing (wear resistant) material, and a third function may be to prevent or retard the reaction of certain metallic phases, such as iron, with the diamond. As a result, the diamond-bearing hard-facing material has exceptional mechanical properties and wear performance and it has been found that the abrasive wear resistance of the coatings exceeds that of WC—Co hard-metals by a factor of 100 or more. In order to obtain these high wear-resistances the diamond-containing hard-metals should comprise at least 3 vol. % or about 10 wt. % diamond.

Advantages of the invention include:

- a highly wear-resistant, hard, fully dense, metallurgically bonded hard-metal hard-facing for steel that is practical and economically viable. The wear resistance of the hard-facing of the invention is comparable to the best thermally sprayed hard-facing solutions commercially available.
- The alloy of the invention readily wets refractory metal carbides, which promotes bonding and retention of the carbide grains as well as infiltration or wicking of the alloy into the pores of the pre-form. The hard-metal based on the refractory carbides with the binder of the Me—Cr—Si—C system can therefore be sintered to full density at very low temperatures.
- No specialised equipment is necessary and the method can be applied using common furnaces under low pressure and/or in an inert atmosphere or conventional equipment for brazing hard-metal tools.
- By using conventional brazing equipment, temperatures and times, the hard facing process can be carried out simultaneously with brazing so that no additional heat treatment operation is needed.
- The heat treatment temperatures required are relatively low, resulting in minimal distortion or degradation of the steel substrate body, or meta-stable phases such as diamond if these are present.
- The heat treatment or sintering times are short minimising any flow of liquid phase during heat treatment or sintering down a complex or non-planar surface to which the coating is applied.

The invention is further illustrated by the following non-limiting Examples.

Example 1

A 1 kg batch of powders comprising 70 wt. % WC powder with a mean diameter of about 0.8 μm, 22.5 wt. % Co powder, 6% $Cr_3C_2$ powder and 1.5 wt. % Si powder was milled for six hours in an attritor mill in a medium of hexane and 20 g paraffin wax and 6 kg hard-metal balls. After milling, the resulting slurry was dried and the powder was screened to eliminate agglomerates. The screened powder was compacted by means of a conventional cold press to form cylindrically-shaped samples, which were sintered at 1160 deg. C. in vacuum for 1 min. The sintered samples had a density of 12.4 g/cm$^3$, hardness (HV30) of 1250, fracture toughness of 14.6 MPa m½ and transverse rupture strength of 2700 MPa. The microstructure of the sample comprised WC, chromium carbide and a binder phase comprising a solid solution of Si, W, C and Cr in Co. These properties are comparable with conventional WC—Co hard-metals having similar binder content.

The presence of Si in the binder was found to increase its resistance to oxidation, as shown in FIG. 1.

Example 2

A 1 kg batch of powders comprising 67 wt. % WC powder with a mean diameter of about 0.8 μm, 24 wt. % Co powder, 6.4% $Cr_3C_2$ powder and 1.6 wt. % Si powder was milled for six hours in an attritor mill in a medium of hexane and 20 g paraffin wax and 6 kg hard-metal balls. After milling, the resulting slurry was dried and the powder was screened to eliminate agglomerates. Diamond grains with mean diameter in the range 300 to 400 um and having a TiC coating with average thickness about 0.5 um were introduced to the resulting powder at a level of 7 wt. %, and blended into the powder by means of a Turbular mixer. The weight percentage of diamond added was calculated to correspond to 20 vol. % diamond in the final sintered product. So, at this stage the mixture comprised 63 wt % WC, 22.5 wt. % Co, 7 wt. % diamond arains, 6 wt. % $Cr_3C_2$ and 1.5 wt. % Si.

The powder mixture was compacted by means of a conventional cold press to form cylindrically-shaped samples, which were sintered at 1160 deg. C. in vacuum for 1 min. Thin foils suitable for transmitted electron microscopy (TEM) were prepared from the sintered sample and subjected to TEM, SEM, Raman spectroscopy and optical microscopy. This analysis revealed no measurable graphitisation of the diamond grains.

The wear-resistance of the sintered sample was examined by using a modified ASTM B611 test, whereby a diamond grinding wheel comprising diamond grains of 150 μm in a resin binder was used instead of a steel wheel and no alumina grit was employed. A fine-grain hard-metal grade with 4% Co was employed as a control. After carrying out the test, the wear of the hard-metal control was equal to $1.7\times10^{-4}$ cm$^3$/rev, whereas that of the diamond-containing hard-metal was equal to $1.5\times10^{-6}$ cm$^3$/rev. In other words, the wear-resistance of the diamond-containing hard-metal was more than two orders of magnitude greater than that of the hard-metal control.

Example 3

A 1 kg batch of powders comprising 30 wt. % WC powder with a mean diameter of about 0.8 μm, 30 wt. % TiC, 20 wt. % Co powder, 10% $Cr_3C_2$ powder and 10 wt. % Si powder was milled for one hour in an attritor mill in a medium of hexane with 6 kg hard-metal balls. After milling, the resulting slurry was dried and the powder was screened to eliminate agglomerates. The resulting powder was mixed with 10% organic binder DECOFLUX® (Zschimmer & Schwarz). The paste obtained in such a way was applied onto the surface of steel substrates (carbon steel, ST50). The substrates with a layer of the paste were heat-treated in vacuum at a temperature of 1220 deg. C. for 2 min to form a continuous coating of roughly 3 mm in thickness on the steel substrate. The coated steel substrates were heat-treated by use of a conventional procedure for heat-treating steels.

The microstructure of the wear-resistant layer comprises facetted or rounded WC and TiC grains of 0.5 to 3.0 μm, rounded grains of (Cr,Co)xCy of nearly 0.5 to 7 μm and interlayers of Co-based binder. The grains of (Cr,Co)xCy have a brown colour after etching in the Murakhami solution for 2 min. The intermediate layer has a thickness of nearly 300 μm and its microstructure comprises dendritic eutectic crystals containing mainly Fe. Cr and Si, which have a yellow colour after etching in the Murakhami solution for 20 sec. The average composition of the interlayer according to EDX results is the following (wt. %): Si-1.2; Cr-1.5; Ti-8.1; W-10.4; the rest being Fe.

The HV10 hardness of the coating was found to be 1150 and microstructural analysis revealed TiC. WC and chromium carbide grains embedded in the matrix of an alloy of Co and Fe containing dissolved Si, W, Ti and Cr. The coated steel substrates obtained in this way were tested by use of the ASTM G65-04 test. Uncoated steel substrates and a test block of WC—Co hard-metals with 8 and 15 wt. % Co and WC mean grain size of roughly 4 μm were used as controls. The mass losses after testing for various samples were as follows: steel—820 mg, hard-metal with 8% Co-75 mg, hard-metal with 15% Co-180 mg, coated steel substrate—80 mg.

The wear-resistance of the coated steel according to the invention was nearly one order of magnitude higher than that of the steel substrate, significantly higher than that of the hard-metal with 15% Co and very close to that of the hard-metals with 8% Co.

Figure 2:
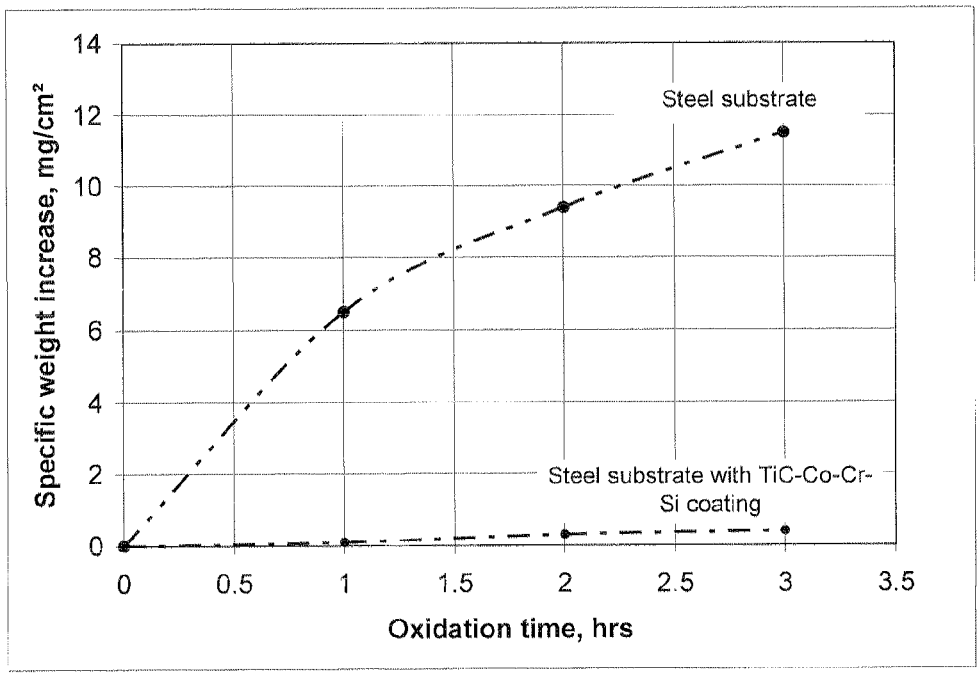
FIG. 2 is a graph showing the oxidation of samples of a steel component and a steel component coated with TiC—Co—Cr—Si hard metal, as a function of time at an applied temperature of about 800 deg. C. The degree of oxidation is indicated by the degree of specific mass increase.
Figure 3:
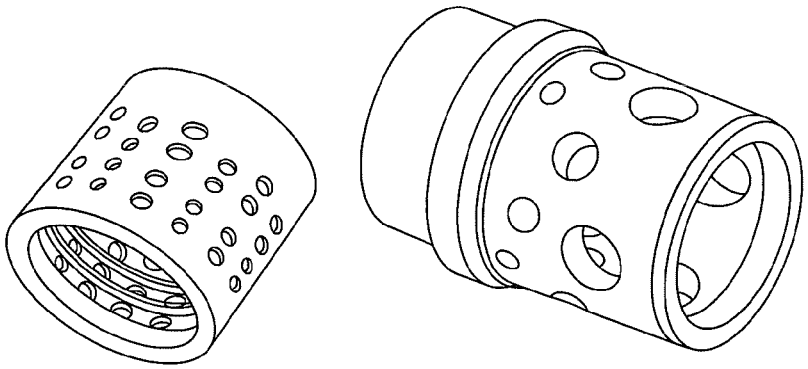
FIG. 3 shows control valves for the oil and gas industry which comprise cylindrical bodies having a plurality of holes formed therein.

The coating was found to be more than 20 times more resistant to oxidation relative to the steel substrate at 800 deg. C. over a period of 3 hours in air, as shown in FIG. 2.

Example 4

A paste was prepared comprising particles of 53 wt. % WC, 9 wt. % $Cr_3C_2$, 3 wt. % Si, 35 wt. % Co and an organic binder. The paste was applied to a portion of the steel body of a pick tool to form a layer with thickness in the range 2 to 3 mm and dried. Conventional brazing equipment was used to melt the paste in a non-oxidising atmosphere for about one minute at an applied temperature of about 1200 deg. C., above the melting point of the paste in the presence of iron at the interface with the steel substrate. The fact that conventional brazing equipment may be used to apply the hard facing is considered to be an important benefit of this method. The uncertainty in the temperature was about 30 deg. C., and it is believed that the applied temperature was about 1250 deg. C. The molten paste was found to be sufficiently viscous that it did not flow substantially during the brazing process. It is believed that the presence of Co in the paste enables brazing to be completed successfully within one minute, thereby shortening the brazing time and minimising flow of the molten coating.

The adherence of the coating to the steel body was excellent and the coating had HV10 hardness of about 1000.

The microstructure of the wear-resistant layer comprises facetted or rounded WC and TiC grains of 0.8 to 3.5 μm, rounded grains of (Cr,Co)xCy of nearly 0.8 to 7 μm and interlayers of Co-based binder. The grains of (Cr,Co)xCy have a brown colour after etching in the Murakhami solution for 2 min. The intermediate layer has a thickness of nearly 220 μm and its microstructure comprises dendritic eutectic crystals containing mainly Fe, Cr and Si, which have a yellow colour after etching in the Murakhami solution for 20 sec. The average composition of the interlayer according to EDX results if the following (wt. %): Si-0.7; Cr-1.2; W-14.4; the rest being Fe.

Example 5

Figure 9:
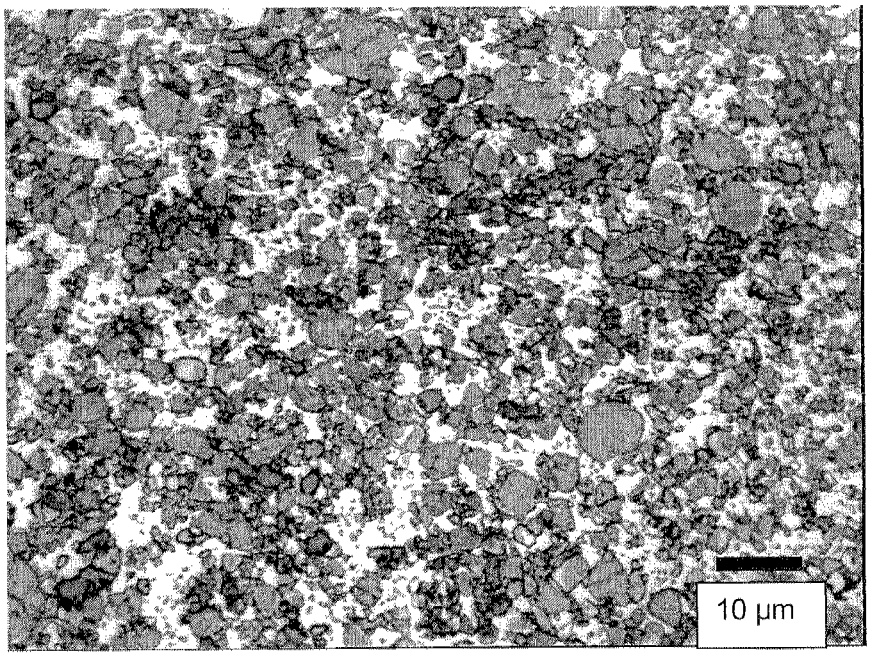
FIG. 9 shows the microstructure of a coating and an intermediate layer of a hard-metal of WC and Fe—Cr—Si—C according to the Example 5, (a) the wear-resistant layer, ×1000, etching in the Murakami reagent for 5 min and (b) the intermediate layer, ×1000, etching in the Murakami reagent for 10 sec.
Figure 9:
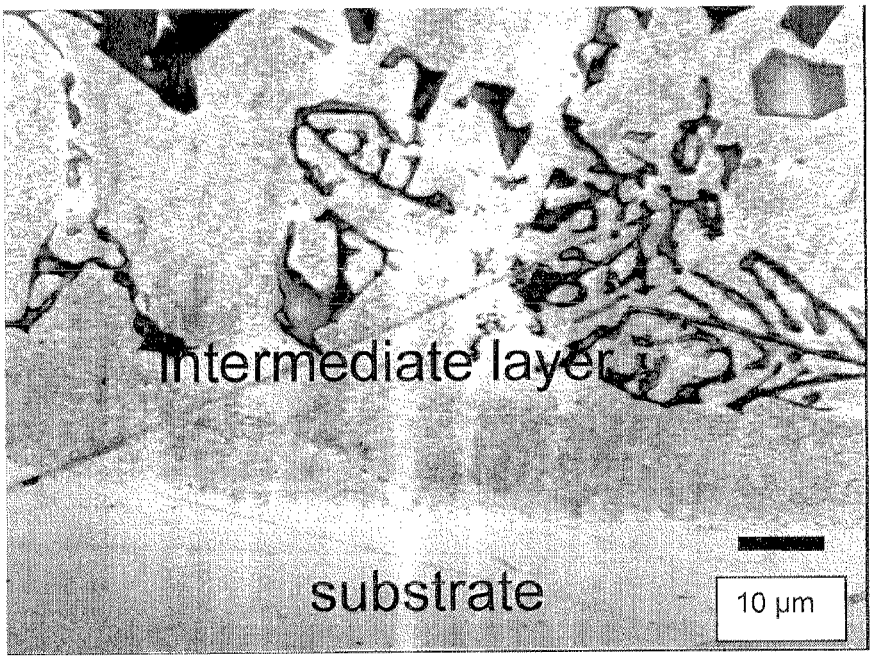

A 1 kg batch of powders comprising 62.7 wt. % WC powder with a mean diameter of about 2.5 μm, 25 wt. % Fe powder, 10% $Cr_3C_2$ powder and 2.3 wt. % Si powder was milled for one hour in an attritor mill in a medium of hexane with 6 kg hard-metal balls. After milling, the resulting slurry was dried and the powder was screened to eliminate agglomerates. The resulting powder was mixed with 12% organic binder DECOFLUX® (Zschimmer & Schwarz). The paste obtained in such a way was applied onto the surface of steel substrates (carbon steel, ST50). The substrates with a layer of the paste were heat-treated in nitrogen at a temperature of 1250 deg. C. for nearly 2 min by use of conventional equipment for brazing to form a continuous coating of roughly 3 mm in thickness on the steel substrate. The coated steel substrates were heat-treated by use of a conventional procedure for heat-treating steels. The HV10 hardness of the coating was found to be 950 and the microstructural and XRD analyses revealed WC and rounded grains of $(Cr,Fe),C_3$ and $(Cr,Fe)_{23}C_6$ embedded in the matrix of an alloy on the basis of Fe containing dissolved Si, W and Cr. After etching the metallurgical cross-section in the Murakahami solution for 2 min the rounded grains had a brown colour. The coated steel substrates obtained in this way were tested by use of the ASTM G65-04 test. Uncoated steel substrates were used as controls. The mass losses after testing for various samples were as follows: steel—820 mg and coated steel substrate—120 mg. Thus, the wear-resistance of the coated steel according to the invention was nearly 7 times higher than that of steel substrate. FIG. 9 shows the microstructure of the coating. The microstructure of the coating comprises facetted or rounded WC grains, grains of $(Cr,Co)_xC_y$ of nearly 0.5 to 5 μm and interlayers of the Co-based binder comprising W, Cr, Si and C. The microstructure of the intermediate layer comprises dendritic eutectic crystals containing mainly Fe. Cr and Si, which are formed as a result of melting the substrate surface region and its interaction with the coating and dispersed in the Fe-based matrix. The interface comprises an intermediate layer formed as a result of melting the steel substrate and its interaction with coating of nearly 200 μm in thickness. The average composition of the interlayer according to EDX results is the following (wt. %): Si-0.5; Cr-4.0; W-25.2; the rest is Fe. The interface comprises dentritic eutectic crystals which after etching in the Murakhanni reagent for 20 seconds had a yellow-brown colour.

Example 6

Figure 10:
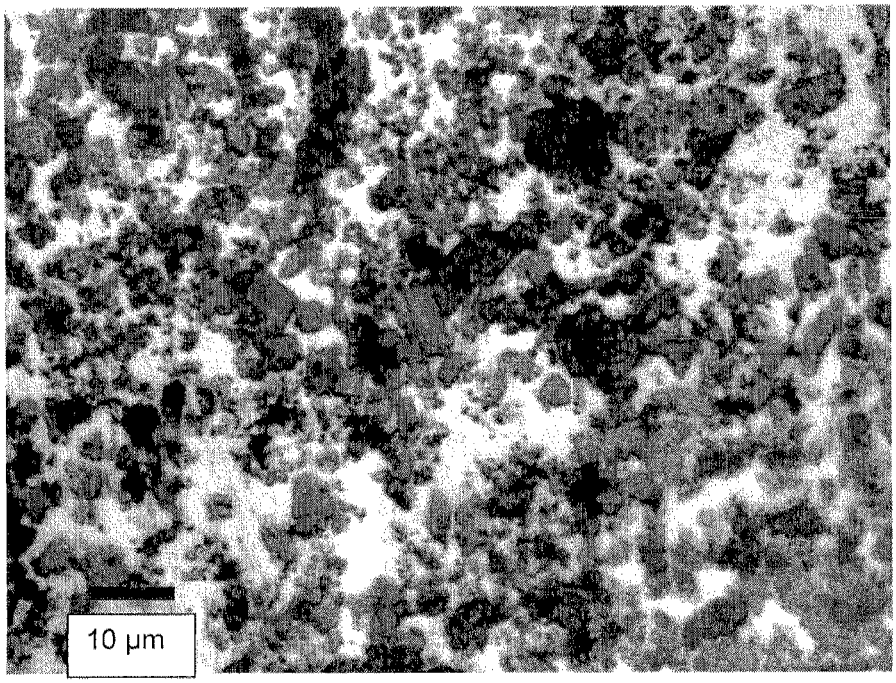
FIG. 10 shows the microstructure of a coating and an intermediate layer of a hard-metal of WC and Co—Cr—Si—C according to the Example 6, (a) the wear-resistant layer, ×1000, etching in the Murakami reagent for 5 min and (b) the intermediate layer, ×100, etching in the Murakami reagent for 10 sec.
Figure 10:
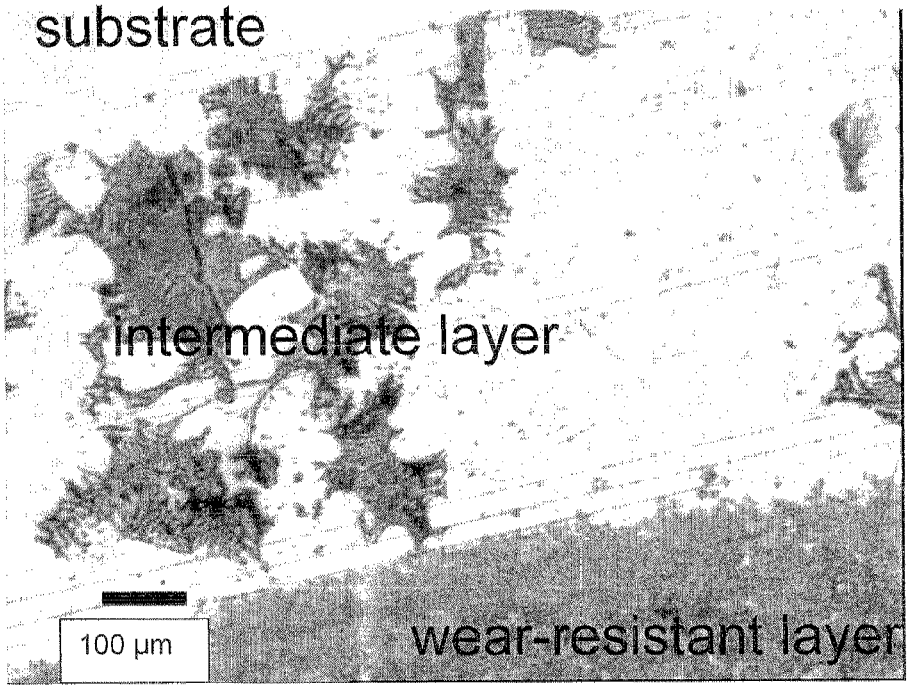
Figure 11:
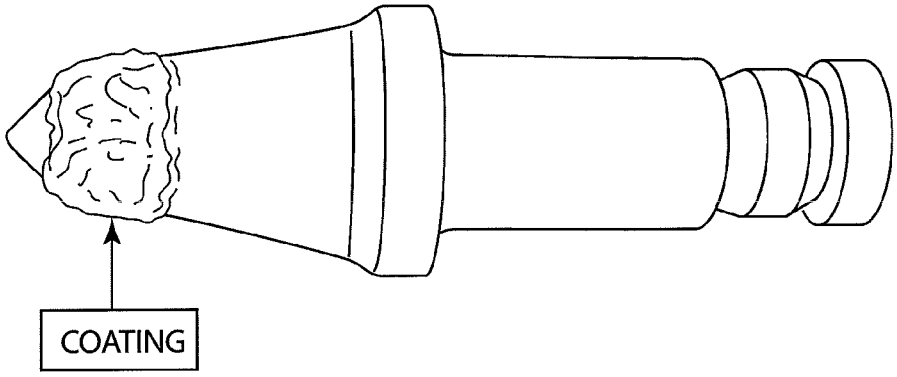
FIG. 11 shows an example of a coal-cutting pick, the coned shaped working portion of which may be coated by a method described in example 6.

A 1 kg batch of powders comprising 57 wt. % WC powder with a mean diameter of about 2.5 μm, 10% $Cr_3C_2$ powder, 2.3 wt. % Si powder and the rest—Co powder was milled for one hour in an attritor mill in a medium of hexane with 6 kg hard-metal balls. After milling, the resulting slurry was dried and the powder was screened to eliminate agglomerates. The resulting powder was mixed with 12% organic binder DECOFLUX® (Zschimmer & Schwarz). The paste obtained in such a way was applied onto the surface of steel substrates and a coal-cutting pick (carbon steel, ST50). The substrates and the pick with a layer of the paste were heat-treated in vacuum at a temperature of 1250 deg. C. for nearly 2 min by use of conventional equipment for brazing to form a continuous coating of roughly 2.5 mm in thickness on the steel substrate. The coated pick is shown in FIG. 11. The coated substrates and the coated pick were heat-treated by use of a conventional procedure for heat-treating steels. The HV10 hardness of the coating was found to be roughly 900 and the microstructural and XRD analyses revealed WC and grains of $(Cr,Co)_7C_3$ and $(Cr,Co)_{23}C_6$ embedded in the matrix of an alloy on the basis of Co containing dissolved Si, W and Cr. The coated steel substrates obtained in this way were tested by use of the ASTM G65-04 test. Uncoated steel substrates were used as controls. The mass losses after testing for various samples were as follows: steel—820 mg and coated steel substrate—160 mg. Thus, the wear-resistance of the coated steel according to the invention was nearly 5 times higher than that of steel substrate. FIG. 10 shows the microstructure of the coating and the coating-substrate interface. The microstructure of the coating comprises facetted or rounded WC grains, grains of $(Cr,Co)_xC_y$ of nearly 0.5 to 10 μm and the Co-based binder comprising W, Cr, Si and C. The microstructure of the intermediate layer comprises dendritic eutectic crystals containing mainly Fe, Cr and Si, which are formed as a result of melting the substrate surface region and its interaction with the coating and dispersed in the Fe-based matrix The interface comprises an intermediate layer formed as a result of meting the steel substrate and its interaction with coating of nearly 570 μm in thickness. The average composition of the interlayer according to the EDX results is the following (wt. %): Si-0.4; Cr-4.3; W-27.5; Co-15.6; the rest is Fe. The interface comprises dentritic eutectic crystals which after etching in the Murakhami reagent for 20 seconds had a yellow-brown colour.

The invention claimed is:

1. A method of producing a wear part or tool comprising a body containing an iron-group metal or alloy, a wear-resistant layer metallurgically bonded to a surface of the body through an intermediate layer, wherein the wear-resistant layer comprises at least 13 vol. % of grains of metal carbide selected from the group consisting of WC, TiC, VC, ZrC, NbC, Mo2C, HfC and TaC and grains of (Cr,Me)xCy, where x and y are variables, with variable y being either 3 or 6 and when variable y is 3 then variable x is 7, and when variable y is 6 then variable x is 23, and a metal based phase comprising of a solid solution of 0.5 to 20 wt. % Cr, 0.2 to 15% wt. Si, and 0.2 to 20 wt. % carbon, where Me is Fe, Co and/or Ni including the steps of:

providing a body formed of an iron group metal or alloy, providing a composition of grains of a metal carbide and the components for a metal based phase comprising an iron-group metal, silicon and $Cr_3C_2$, in particulate form, applying a layer of the composition to a surface of the body, forming the intermediate layer and the wear-resistant layer at the same time by:

(1) raising the temperature of the layer and the surface of the body to above the liquidus of the components for the metal based phase and surface of the body, (2) maintaining the raised temperature for a period of time of 30 seconds to 5 minutes to form the intermediate layer having a thickness of 0.05 to 1 mm and comprising Si in an amount of 0.1 to 0.7 times that in the wear-resistant layer, chromium in amount of 0.1 to 0.6 times that in the wear-resistant layer and the metal of the metal carbide in amount of 0.2 to 0.6 times that in the wear-resistant layer, and (3) reducing temperature of the components and surface of the body to a temperature below the liquidus temperature.

2. A method according to claim 1 wherein the raised temperature is maintained for a period of 30 seconds to 3 minutes.

3. A method according to claim 1 wherein the raised temperature is maintained for a period of 30 seconds to 2 minutes.

4. A method according to claim 1 wherein the composition of metal carbide and components for the metal based phase is in the form of a paste, tape or strip.

5. A method according to claim 1 wherein the raised temperature is in the range 1150 degrees C. to 1300 degrees C.

6. A method according to claim 1 wherein the raised temperature is below 1160 degrees C.

7. A method according to claim 1 wherein the grains of the metal carbide are either WC or TiC.

8. A method according to claim 7 wherein Me is Co.

* * * * *